US012332040B2

(12) United States Patent
Satern

(10) Patent No.: US 12,332,040 B2
(45) Date of Patent: Jun. 17, 2025

(54) ORDNANCE DISARMING DEVICE

(71) Applicant: Liberty Barrels, Inc., Estherville, IA (US)

(72) Inventor: Steven R. Satern, Estherville, IA (US)

(73) Assignee: Liberty Barrels, Inc., Estherville, IA (US)

( * ) Notice: Subject to any disclaimer, the term of this patent is extended or adjusted under 35 U.S.C. 154(b) by 0 days.

(21) Appl. No.: 18/955,189

(22) Filed: Nov. 21, 2024

(65) Prior Publication Data

US 2025/0164226 A1 May 22, 2025

Related U.S. Application Data

(60) Provisional application No. 63/601,408, filed on Nov. 21, 2023.

(51) Int. Cl.

| | |
|---|---|
| ***F42D 5/04*** | (2006.01) |
| ***F41A 21/10*** | (2006.01) |
| ***F41A 21/36*** | (2006.01) |

(52) U.S. Cl.

CPC ..... *F42D 5/04* (2013.01); *F41A 21/10* (2013.01); *F41A 21/36* (2013.01)

(58) Field of Classification Search

CPC ..... F42D 5/04; F41A 21/10; F41A 21/36

USPC ..... 86/50

See application file for complete search history.

(56) References Cited

U.S. PATENT DOCUMENTS

| | | | | |
|---|---|---|---|---|
| 10,054,388 | B1 * | 8/2018 | Langner | F41B 9/0046 |
| 10,066,916 | B1 * | 9/2018 | Vabnick | F42B 12/82 |
| 10,126,106 | B1 | 11/2018 | Langner | |
| 10,495,433 | B1 | 12/2019 | Langner | |
| 10,794,660 | B2 * | 10/2020 | Vabnick | F41B 9/0046 |
| 11,243,038 | B1 * | 2/2022 | Langner | F41A 21/10 |
| 2021/0041205 | A1 * | 2/2021 | Vabnick | F42B 12/745 |
| 2021/0404785 | A1 * | 12/2021 | Sasnett | F42D 5/04 |

* cited by examiner

*Primary Examiner* — Samir Abdosh

(74) *Attorney, Agent, or Firm* — McKee, Voorhees & Sease, PLC

(57) ABSTRACT

An ordnance disarming device in the form of a percussion active, non-electric disrupter has an outer barrel and an inner barrel extending through the outer barrel. A receiver/breech cap is threaded onto the forward end of the inner barrel. The receiver/breech cap has exhaust ports for expelling combustion gasses, so as to function as a muzzle brake. The receiver/breech cap automatically centers the inner barrel in the outer barrel, such that the assembly is self-centering. No O-rings are needed, such that the device can be used in extreme temperatures.

23 Claims, 5 Drawing Sheets

ORDNANCE DISARMING DEVICE

CROSS-REFERENCE TO RELATED APPLICATION

This application claims priority under 35 U.S.C. § 119 to Provisional Application U.S. Ser. No. 63/601,408, filed on Nov. 21, 2023, which is herein incorporated by reference in its entirety including without limitation, the specification, claims, and abstract, as well as any figures, tables, or examples thereof.

BACKGROUND

Explosive devices, such as ordnance, land mines, bombs, and improvised or homemade devices are often found undetonated, and thus create hazardous risks to those who find or accidentally discover such remnants. Safely disarming such explosive remnants requires skill and special equipment. One particular tool used to deactivate and dispose of these live and dangerous explosive weapons is a disruptor projectile shot into the explosive from a safe distance to detonate or deactivate the explosive. Two common types of disruptors include a percussion activated non-electric (PAN) disruptor, and an electrically initiated disruptor. The projectile may be various sizes, including existing and future cartridges as those certified by CIP and SAAMI, as well as "Wildcat" cartridges that are uncertified, non-CIP and non-SAAMI cartridges.

U.S. patent No. 11,243,038 describes one type of PAN disruptor, wherein an inner barrel is inserted into an outer barrel and secured by a plurality of O-rings. However, in certain situations and environments, such a PAN disruptor is not suitable, since O-rings break, crack, shrink, or disintegrate, such as in extreme temperature conditions. Therefore, there is a need in the industry for an ordnance disarming device which is suitable in all environments, including extreme temperatures.

Accordingly, a primary objective of the present invention is the provision of an improved ordnance disarming device for use in all weather conditions.

Another objective of the present invention is the provision of an improved ordnance disarming device that utilizes conventional projectiles.

A further objective of the present invention is the provision of an ordnance disarming device which utilizes a PAN disrupter with a metal centering device for the inner liner barrel, and without the use of O-rings.

Another objective of the present invention is a provision of a self-centering device for the inner barrel insert of a PAN disruptor that functions as a muzzle brake to reduce recoil.

A further objective of the present invention is the provision of an ordnance disarming device wherein the receiver/breech cap has a conical end to mount into the forward end of the outer barrel and threadably receives the forward end of the inner barrel so as to automatically center the inner barrel within the outer barrel.

Still another objective of the present invention is the provision of a method of safely detonating an explosive device from a distance using a PAN disruptor which is free of O-Rings.

Yet another objective of the present invention is the provision of a safe method of disarming an undetonated ordnance in extreme temperature conditions.

These and other objectives become apparent from the following description of the invention.

DETAILED DESCRIPTION

Figure 1:
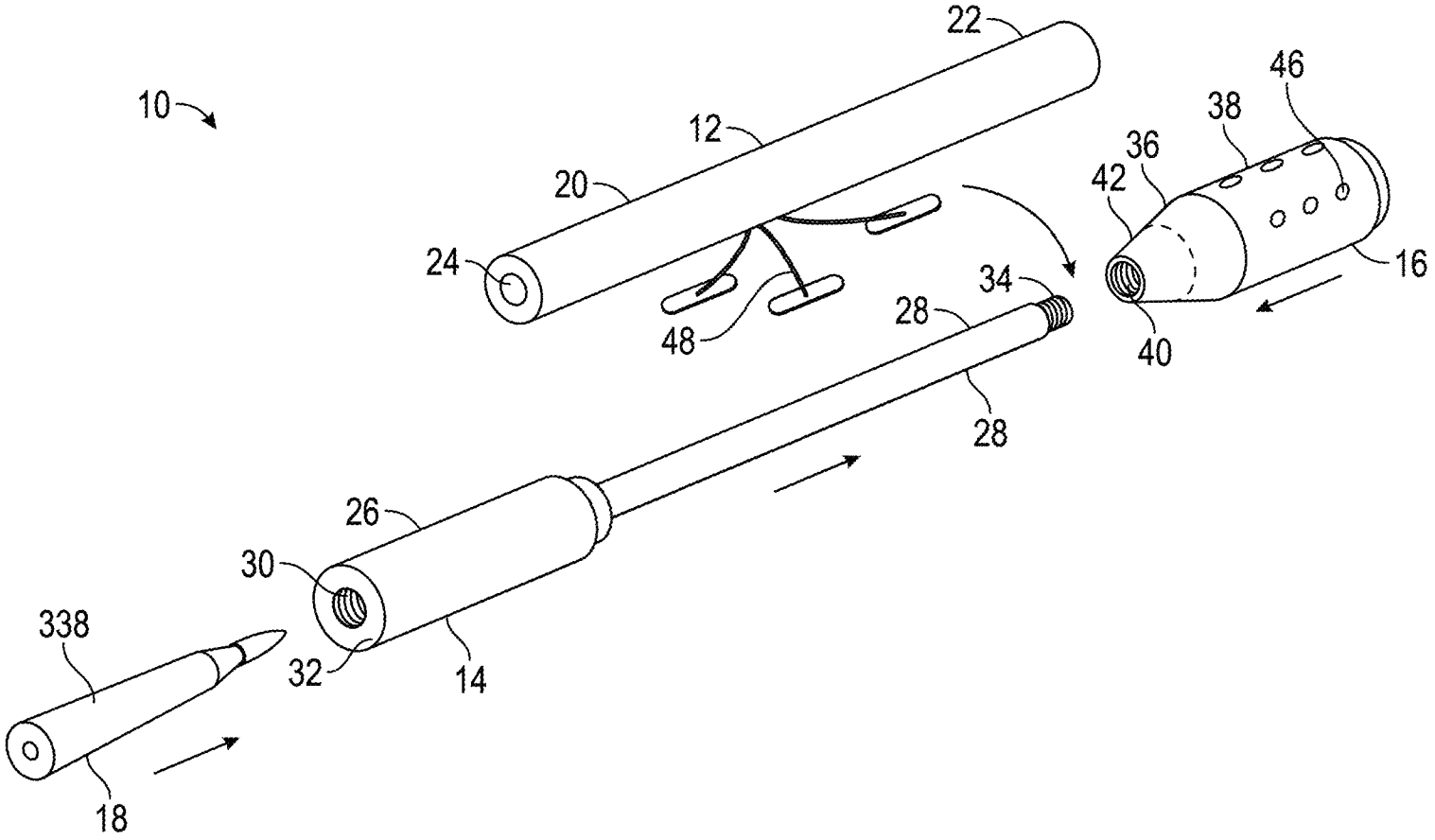
FIG. 1 is an exploded perspective view of the ordnance disarming device of the present invention, set upon a tripod, and with a cartridge for use with the device.

The ordnance disarming device of the present invention is generally designated by the reference 10 in the drawings. The device 10 includes an outer barrel 12, an inner barrel 14, and a receiver/breech cap 16. A conventional projectile 18, such as a 338 NORMA cartridge, is used in the assembled device 10 to safely disarm ordinance.

The outer barrel includes a breach or rear end 20, a muzzle or front end 22, and a longitudinal bore 24. The inner barrel 14 includes a breach or rearward end 26, a muzzle or front end 28, and a longitudinal bore 30. The rear end 26 of the inner barrel 14 includes a rim 32, and the front end 28 includes external threads 34. The receiver/breech cap 16 includes a conically tapered rear end 36, a cylindrical forward rear end 38, and a longitudinal bore 40. The rear end 36 of the receiver/breech cap bore 40 includes internal threads 42.

Figure 2:
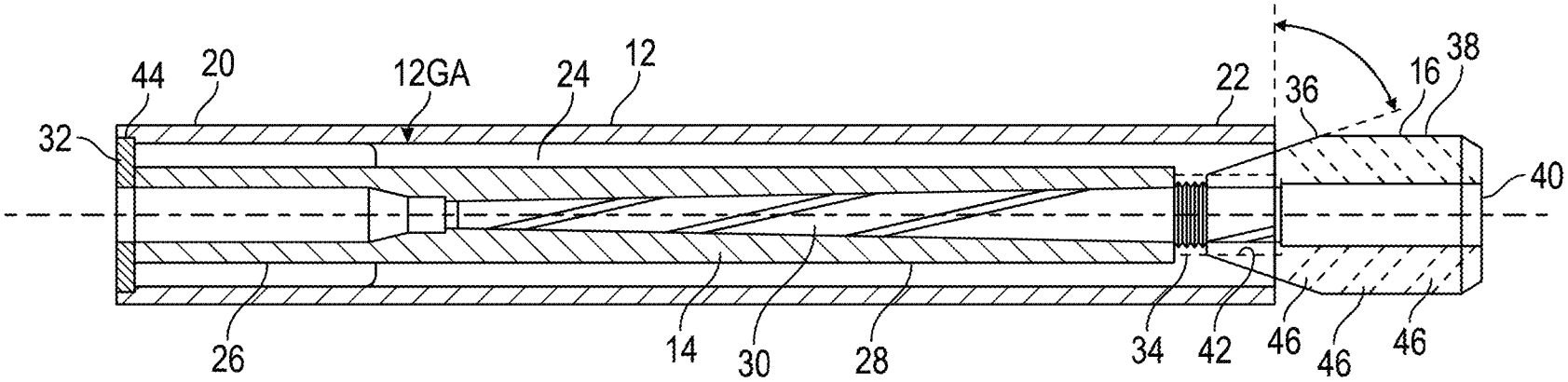
FIG. 2 is a sectional view of the device.
Figure 3:
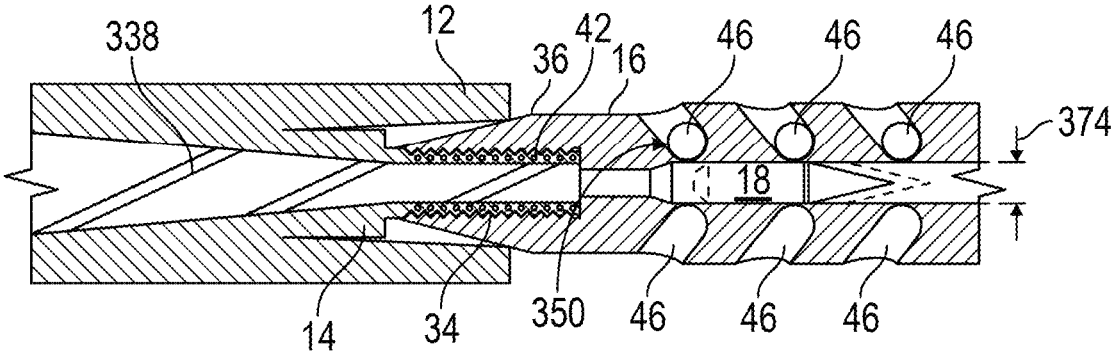
FIG. 3 is a sectional sketch of the forward or muzzle end of the device.
Figure 4:
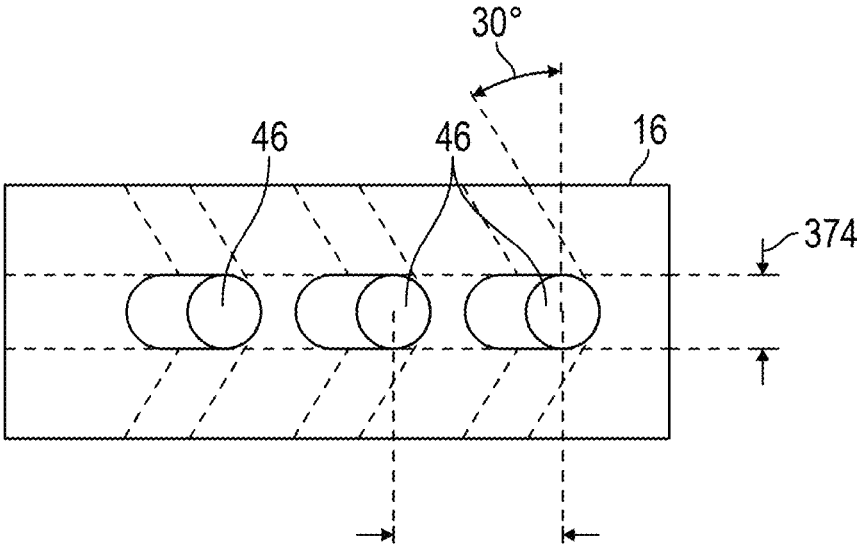
FIG. 4 is a sectional view showing the gas ports of the receiver/breech cap.

To assemble the device 10, the inner barrel 14 is inserted into the outer barrel 12 from the rear end 20 of the outer barrel. The threaded conical rear end 20 of the receiver/breech cap 16 is fit into the forward end 22 of the outer barrel 12, and screwed onto the threaded forward end 28 of the inner barrel 14, as seen in FIG. 2. The rim 32 of the inner barrel is seated within a recess 44 on the rear end 20 of the outer barrel. The conical shape of the receiver/breech cap rear end 36 automatically centers the inner barrel 14 within the outer barrel 12, as shown in FIG. 2, so that the inner barrel bore 30 and receiver/breech cap bore 40 are coextensive with one another.

Figure 5:
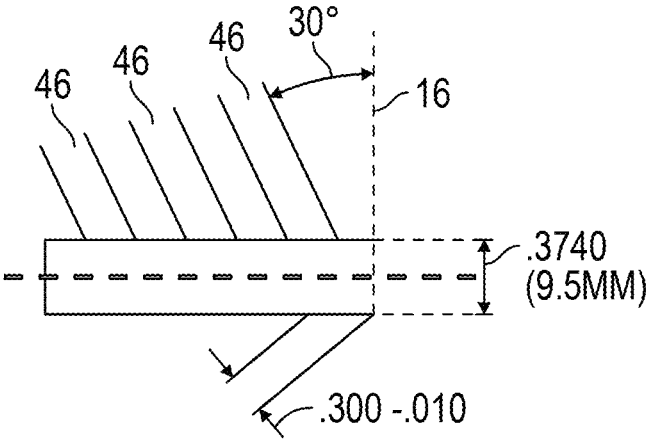
FIG. 5 is a sectional view of the receiver/breech cap showing the angle of the gas ports.
Figure 6:
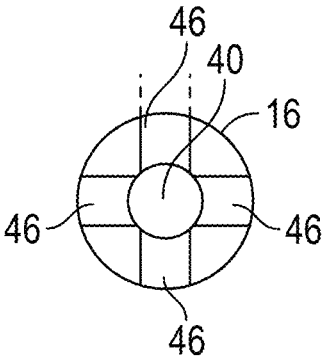
FIG. 6 is a sectional view of the receiver/breech cap showing gas ports at 90°.
Figure 7:
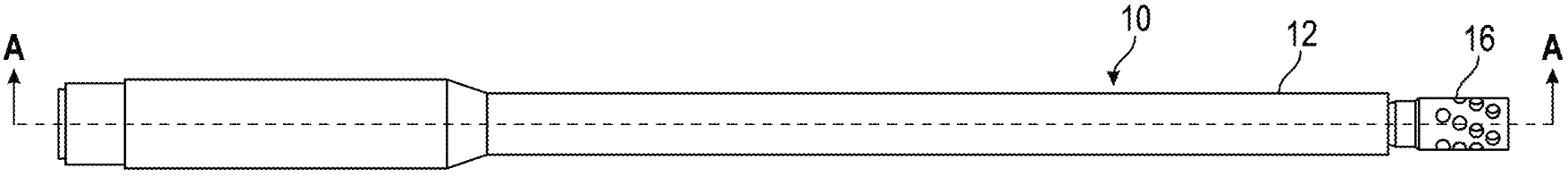
FIG. 7 is an elevation view of the assembled ordnance disarming device of the present invention, with a projectile cartridge inserted into the rear end of the device.
Figure 8:
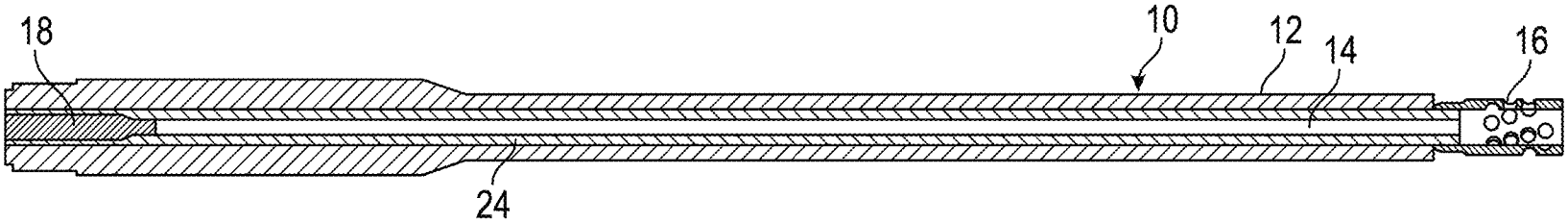
FIG. 8 is a sectional view of the device of FIG. 7 taken along lines A-A of FIG. 7.
Figure 9:
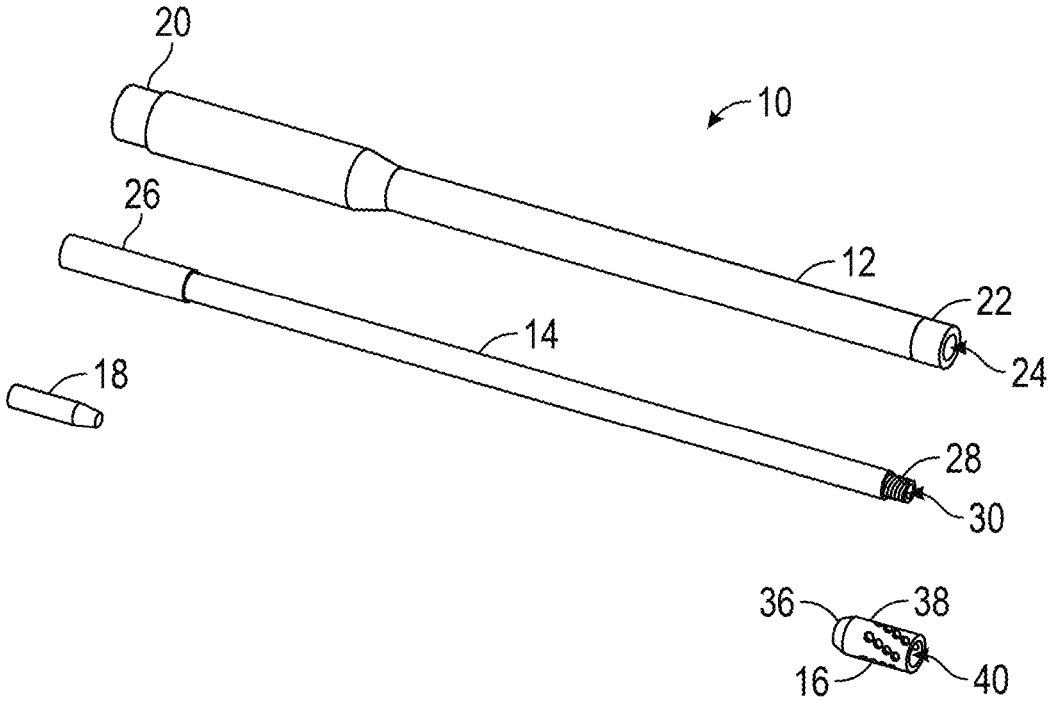
FIG. 9 is an exploded perspective view of the device shown in FIG. 7.

The receiver/breech cap 16 includes a plurality of ports 46 extending outwardly from the bore 40. Preferably, the ports 46 slope rearwardly from the bore 40, approximately 30-45°, as shown in FIGS. 2 and 5. The number of ports may vary. The spacing between ports may also vary. For example, the ports 46 may be spaced 90° apart, as shown in FIG. 6, or alternatively, can be spaced 120° apart. The ports allow combustion gases to be expelled from the receiver/breech cap, such that the receiver/breech cap functions as a muzzle brake or recoil compensator for the device 10.

The device 10 preferably is mounted on a tripod 48 or other support structure. The projectile or cartridge 18 is inserted into the bore 30 of the inner barrel 14. A conventional firing cap (not shown) or other detonation means is used to shoot the cartridge 18 through the bores 30 and 40 at the target ordnance, to thereby disarm the ordnance.

The receiver/breech cap 16 is preferably made of metal, or similar material, which can withstand extreme temperature conditions, so as to avoid cracking, breaking, or other failure.

The device 10 has dual functionality, in centering the inner barrel 14 within the outer barrel 12 through the seated rim 32 on the rear end and the threaded receiver/breech cap 16 on the front end, and reducing recoil upon firing of the cartridge 18 via the gas exhaust ports 46 on the receiver/breech cap 16. The assembly of the components eliminates the need for an O-ring, as in conventional disruptors. Thus, the device 10 accomplished at least all of the stated objectives.

The "scope" of the present disclosure is defined by the appended claims, along with the full scope of equivalents to which such claims are entitled. The scope of the disclosure is further qualified as including any possible modification to any of the aspects and/or embodiments disclosed herein which would result in other embodiments, combinations, subcombinations, or the like that would be obvious to those skilled in the art.

What is claimed is:

1. An ordnance disarming device, comprising:

an outer barrel having forward and rearward ends, and a longitudinal bore;

an inner barrel inserted into the outer barrel, the inner barrel having forward and rearward ends, and a longitudinal bore; and a receiver at the forward end of the outer barrel and receiving the forward end of the inner barrel so as to center the inner barrel axially within the outer barrel, and having a longitudinal bore; and the inner barrel and receiver being adapted to expel a projectile forwarding to disarm the ordnance.

2. The ordnance disarming device of claim 1 wherein the bore of the receiver extends co-extensively with the bore of the inner barrel.

3. The ordnance disarming device of claim 1 wherein the forward end of the inner barrel is externally threaded and the receiver has a rearward end with internal threads for threadably coupling with the inner barrel.

4. The ordnance disarming device of claim 1 wherein the receiver has ports to discharge combustion gases from the inner barrel.

5. The ordnance disarming device of claim 1 wherein the inner barrel has a rim on the rearward end to engage the rearward end of the outer barrel.

6. The ordnance disarming device of claim 5 wherein the rim seats within a recess in the rearward end of the outer barrel.

7. The ordnance disarming device of claim 1 wherein the rearward end of the receiver has a conical shape so as to be self-centering in the bore of the outer barrel.

8. The ordnance disarming device of claim 1 wherein the receiver is a muzzle brake to reduce recoil.

9. The ordnance disarming device of claim 1 wherein the outer and inner barrels form a percussion activated, non-electric assembly.

10. The ordnance disarming device of claim 1 wherein the receiver is metallic for use in extreme temperatures.

11. The ordnance disarming device of claim 1 wherein the inner and outer barrels are free from an O-ring.

12. A method of assembling a percussion activated, non-electric disrupter, comprising:

inserting an inner barrel into a rear end of an outer barrel;

threadably coupling a receiver to a front end of the inner barrel adjacent a front end of the outer barrel, without the use of an O-ring.

13. The method of claim 12 further comprising seating a rim on a rear end of the inner barrel into a recess on the rear end of the outer barrel.

14. The method of claim 13 wherein the inner barrel is automatically centered in the outer barrel.

15. The method of claim 12 wherein the receiver is automatically centered in the outer barrel.

16. A percussion activated, non-electric disrupter, comprising:

an outer barrel;

an inner barrel mounted co-extensively in the outer barrel without the use of an O-ring;

a muzzle brake on a forward end of the inner barrel; and the inner barrel and the muzzle brake being threadably coupled.

17. A percussion activated, non-electric disrupter, comprising:

an outer barrel;

an inner barrel mounted co-extensively in the outer barrel without the use of an O-ring;

the inner barrel and the muzzle brake being threadably coupled; and a muzzle brake on a forward end of the inner barrel.

18. The percussion activated, non-electric disrupter of claim 17 wherein the inner barrel and the muzzle brake are threadably coupled.

19. The percussion activated, non-electric disrupter of claim 16 wherein the receiver has external gas exhaust ports beyond the outer barrel.

20. The percussion activated, non-electric disrupter of claim 16 wherein the outer and inner barrel have rear ends which are seated together.

21. The percussion activated, non-electric disrupter of claim 20 wherein the rear end of the inner barrel has a rim matingly received in a recess in the rear end of the outer barrel.

22. The percussion activated, non-electric disrupter of claim 17 wherein the receiver has external gas exhaust ports beyond the outer barrel.

23. The percussion activated, non-electric disrupter of claim 17 wherein the rear end of the inner barrel has a rim matingly received in a recess in the rear end of the outer barrel.

* * * * *